US011020870B2

(12) United States Patent
Pienta

(10) Patent No.: US 11,020,870 B2
(45) Date of Patent: Jun. 1, 2021

(54) APPARATUS FOR SLABBING ROLLS OF TISSUE

(71) Applicant: Five Brothers Properties, LTD, Lambertville, MI (US)

(72) Inventor: David J. Pienta, Lambertville, MI (US)

(73) Assignee: Automatic Handling International, Inc., Erie, MI (US)

( * ) Notice: Subject to any disclaimer, the term of this patent is extended or adjusted under 35 U.S.C. 154(b) by 0 days.

(21) Appl. No.: 16/663,509

(22) Filed: Oct. 25, 2019

(65) Prior Publication Data

US 2020/0130216 A1 Apr. 30, 2020

Related U.S. Application Data

(60) Provisional application No. 62/753,246, filed on Oct. 31, 2018.

(51) Int. Cl.

| | |
|---|---|
| ***B65H 73/00*** | (2006.01) |
| ***B26D 5/00*** | (2006.01) |
| ***B26D 7/01*** | (2006.01) |

(52) U.S. Cl.

CPC ..... *B26D 5/00* (2013.01); *B26D 7/015* (2013.01); *B65H 73/00* (2013.01); *B26D 2007/013* (2013.01)

(58) Field of Classification Search

CPC ..... B65H 73/00; B65B 69/0025
USPC ..... 83/924
See application file for complete search history.

(56) References Cited

U.S. PATENT DOCUMENTS

| | | | | |
|---|---|---|---|---|
| 4,437,223 | A * | 3/1984 | Petros | B23D 17/06 29/56.5 |
| 5,305,671 | A * | 4/1994 | Wachs | B23D 45/003 29/762 |
| 5,367,930 | A * | 11/1994 | Lemley | B23D 45/003 83/368 |
| 2005/0211040 | A1* | 9/2005 | Bilskie | B26D 1/18 83/485 |
| 2007/0000438 | A1* | 1/2007 | Milton | B65H 19/12 118/258 |
| 2008/0288100 | A1* | 11/2008 | Moisio | G05B 19/41875 700/127 |
| 2011/0035041 | A1* | 2/2011 | Habakus | B65H 16/10 700/108 |
| 2012/0137462 | A1* | 6/2012 | Pienta | B65H 73/00 15/256.51 |
| 2014/0361065 | A1* | 12/2014 | Ishimatsu | B65H 23/06 226/38 |
| 2015/0053810 | A1* | 2/2015 | Chang | B65H 26/08 242/563 |
| 2017/0050330 | A1* | 2/2017 | Kerwin | B26D 1/385 |
| 2017/0121142 | A1* | 5/2017 | Hagi | B41J 15/042 |
| 2019/0118529 | A1* | 4/2019 | Wong | B41F 33/16 |
| 2019/0308839 | A1* | 10/2019 | Schubring | B65H 23/044 |

* cited by examiner

*Primary Examiner* — Kenneth E Peterson
(74) *Attorney, Agent, or Firm* — Schaffer, Schaub & Marriott, Ltd.

(57) ABSTRACT

An unlaid slabbing apparatus capable of profiling a roll of tissue material by determining the diameter, circumference, and weight of the roll. The slabbing apparatus calculates the amount of material to be removed based on operator input and predetermined parameters of weight, diameter, and density.

5 Claims, 5 Drawing Sheets

APPARATUS FOR SLABBING ROLLS OF TISSUE

CROSS-REFERENCE

The present patent application is based upon and claims the benefit of provisional patent no. 62/753,248, filed Oct. 31, 2018.

BACKGROUND OF THE INVENTION

When manufacturing paper products, large rolls of tissue paper are provided for processing into various products such as bath tissue, paper towels, air dried, and crepe air dried materials such as napkins. The rolls of tissue are provided on cores and may weigh up to 8,000 pounds. The tissue is rolled on the core and may be 90 inches in diameter. Paper manufacturers receive these rolls and unwind them to process the tissue paper into the various products being manufactured. Problems are sometimes encountered with the rolls of tissue in that the tissue may be too thin or too thick and cannot be processed on the converting operations downline. The paper mill does not want to waste the tissue or fiber on the problematic roll and wishes to reclaim that tissue and fiber for remanufacturing and rewinding into usable material. If the roll is a fresh roll it is called a parent roll. If the roll is left-over scrap it may be commonly referred to as a broke roll. A broke roll may be also designated because there is an imperfection in the material grade of the tissue or an issue with the actual manufacturing process that requires the product to be designated as non-usable. It is desirable to reclaim fiber from the broke material. Reclaiming the fiber allows it to be converted back into a fresh roll of usable material.

Efforts to reclaim material from a broke roll for reprocessing have included operator intervention wherein the operators use sharp knives to specifically slice the damaged material off of the core. This process creates safety hazards for the users.

Another commonly used method to remove broke material makes use of a machine called a guillotine which will chop rolls with brute force. The guillotine chops the roll in half, destroying the paper tissue and the core. The core material gets intermixed with the paper tissue and will have to be separated manually before the paper tissue can be recycled for reprocessing. Further, the use of a guillotine is undesirable because it destroys the core. Cores are generally very expensive in the manufacturing process and most manufacturers wish to preserve the cores for reuse. The guillotine unacceptably destroys the core, makes the broke tissue removed from the core impure, and involves added labor. This process creates safety hazards for the users.

There is a need for effectively cleaning damaged tissue off of broke rolls without damaging the core.

There is a further need for effectively cleaning damaged tissue off of cores without additional operator labor.

There is an additional need for cleaning fiber of damaged tissue off of broke rolls without threatening operator safety.

Finally, there is a need to remove the tissue from rolls of various sizes and to be able to measure the amount of material being cut off and to control the amount of material being cut off based on the weight of the product, diameter of the roll, material type and other parameters.

SUMMARY OF THE INVENTION

The slabbing apparatus of the present invention is an automated machine capable of profiling a roll of tissue material by determining the diameter, circumference, and weight of the roll. The apparatus calculates the amount of material to be removed based on operator input and determined parameters of weight, diameter, and density. The apparatus includes a hoist and at least one weight measurement sensor 70 which determines the weight of the roll and helps position the roll so that the cut and removed material will fall to a desired location. The present invention will be able to slab narrow slit rolls, long width rolls, and various width rolls in between. It is able to measure the amount of material being cut off and to control the amount of material being cut off based on the weight of the product, diameter, material type, and information received from load cells located on the hoist. The invention further includes a torque sensor 60 on the cutting blade to determine variations in the condition of the tissue being cut and removed and automatically stopping the cutting action if the torque falls outside of an acceptable parameter. The apparatus of this invention will use chucks that are conical shaped in order to accommodate variations in core size when engaging and lifting the core. The invention can also be used with a core cleaner or core joiner for removing all material left on cores and repairing clean cores for further use.

The present invention can be used with various options such as core clamps, expanding chucks, take away conveyers, accumulation tables, and pulp making machines.

This invention will reclaim fiber from a broke roll or a damaged parent roll. This reclaimed fiber can be used and converted back into a fresh roll of usable material. Paper mills manufacture these rolls in batches. When one parent roll ends up unusable because the tissue may be too thin or too thick making it unable to be processed on the downstream converting operations, the entire batch of rolls may need to be reprocessed. The present invention is designed to assist with this reprocessing.

DETAILED DESCRIPTION OF THE INVENTION

Figure 1:
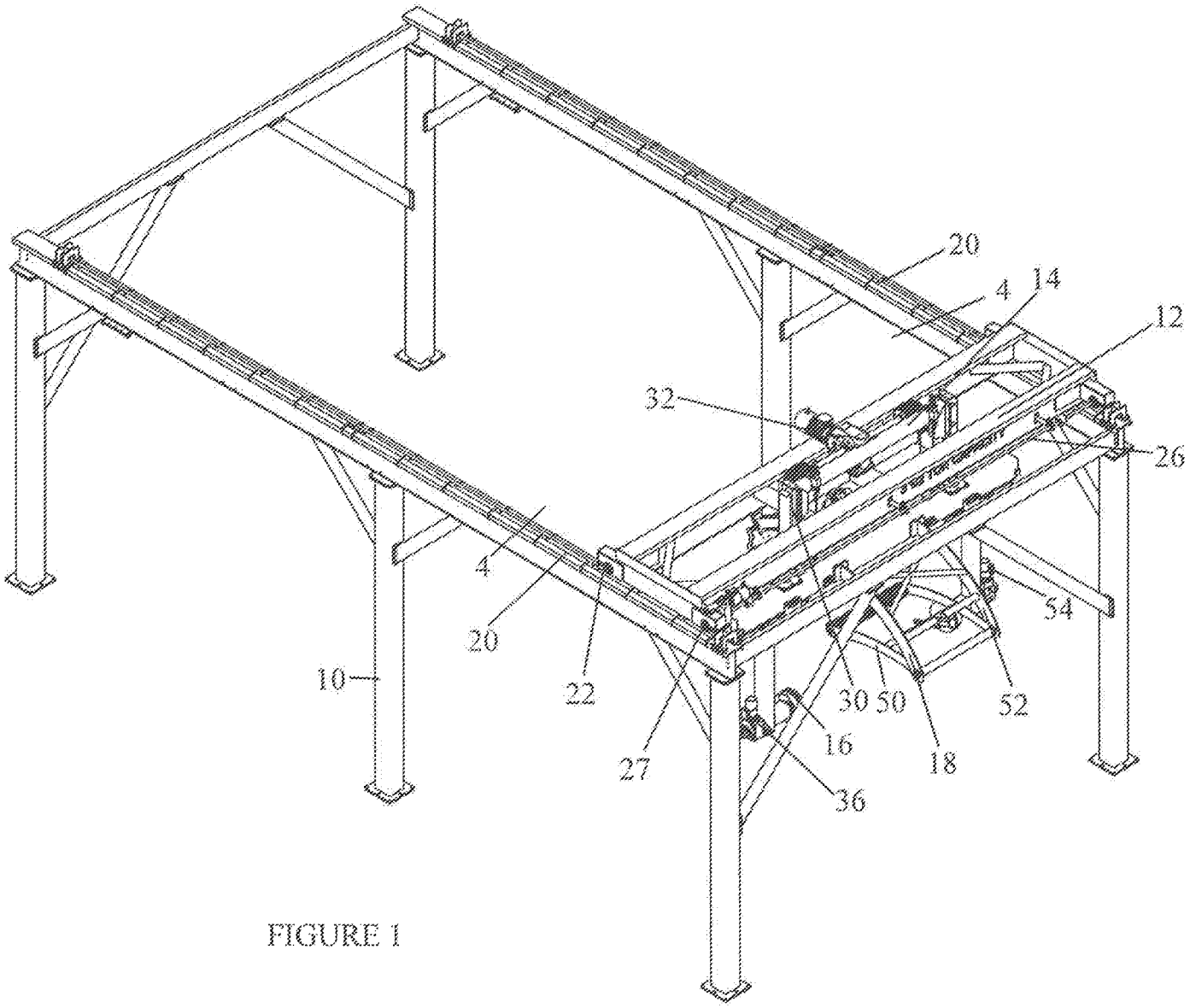
FIG. 1 is a perspective view of the apparatus of the present invention.
Figure 2:
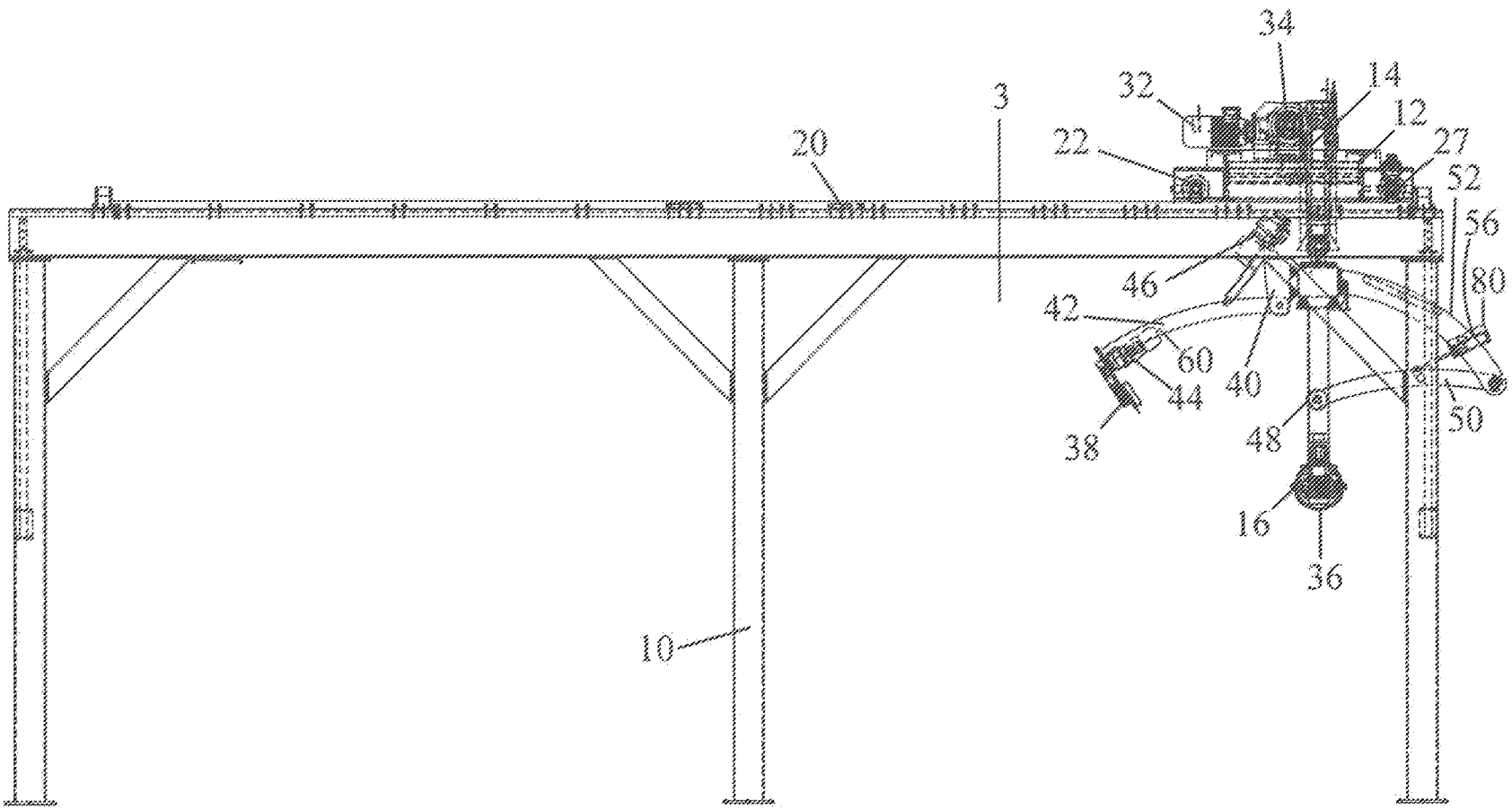
FIG. 2 is a side elevation view of the apparatus of FIG. 1.
Figure 3:
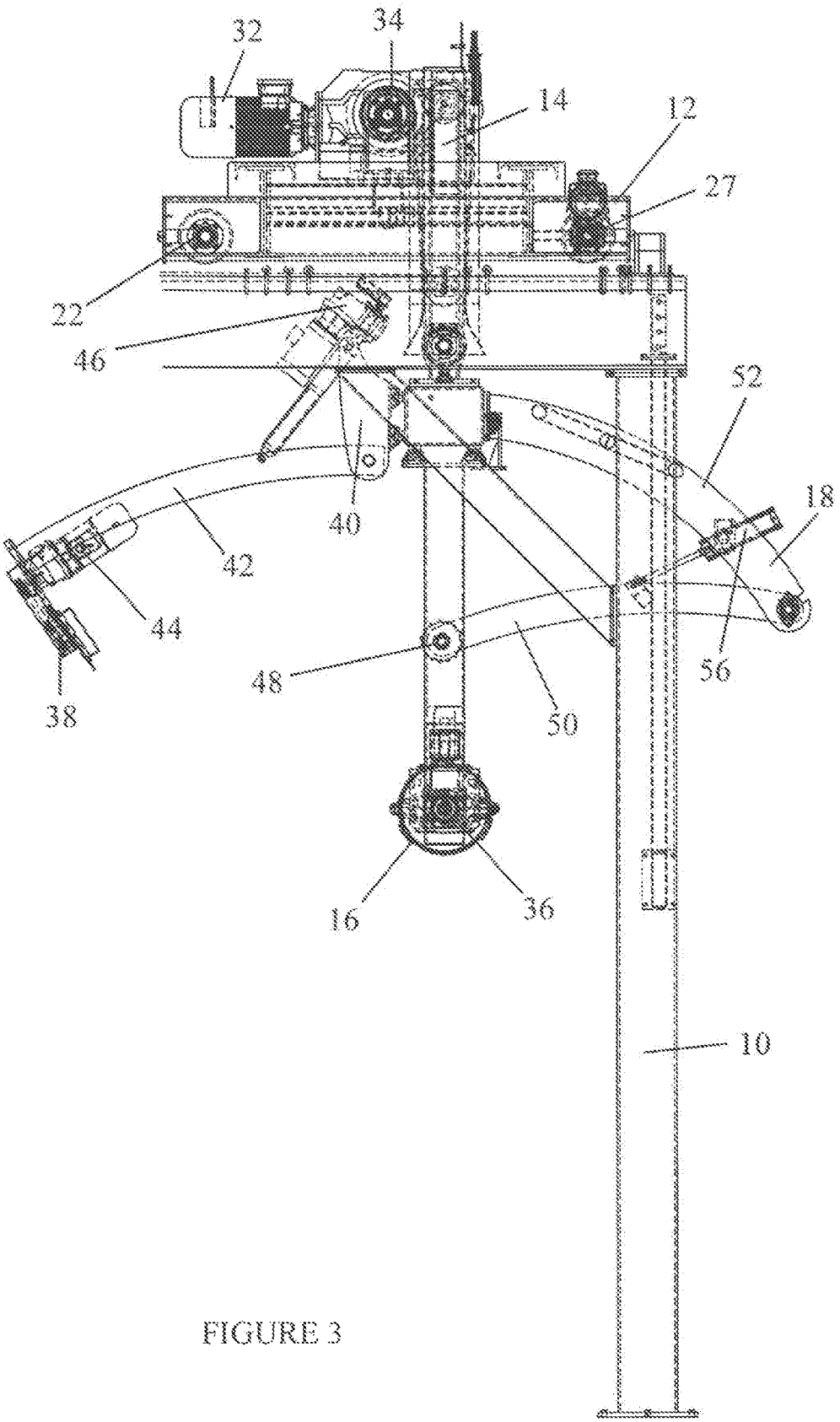
FIG. 3 is a segmented view taken along lines 3-3 of FIG. 2.
Figure 4:
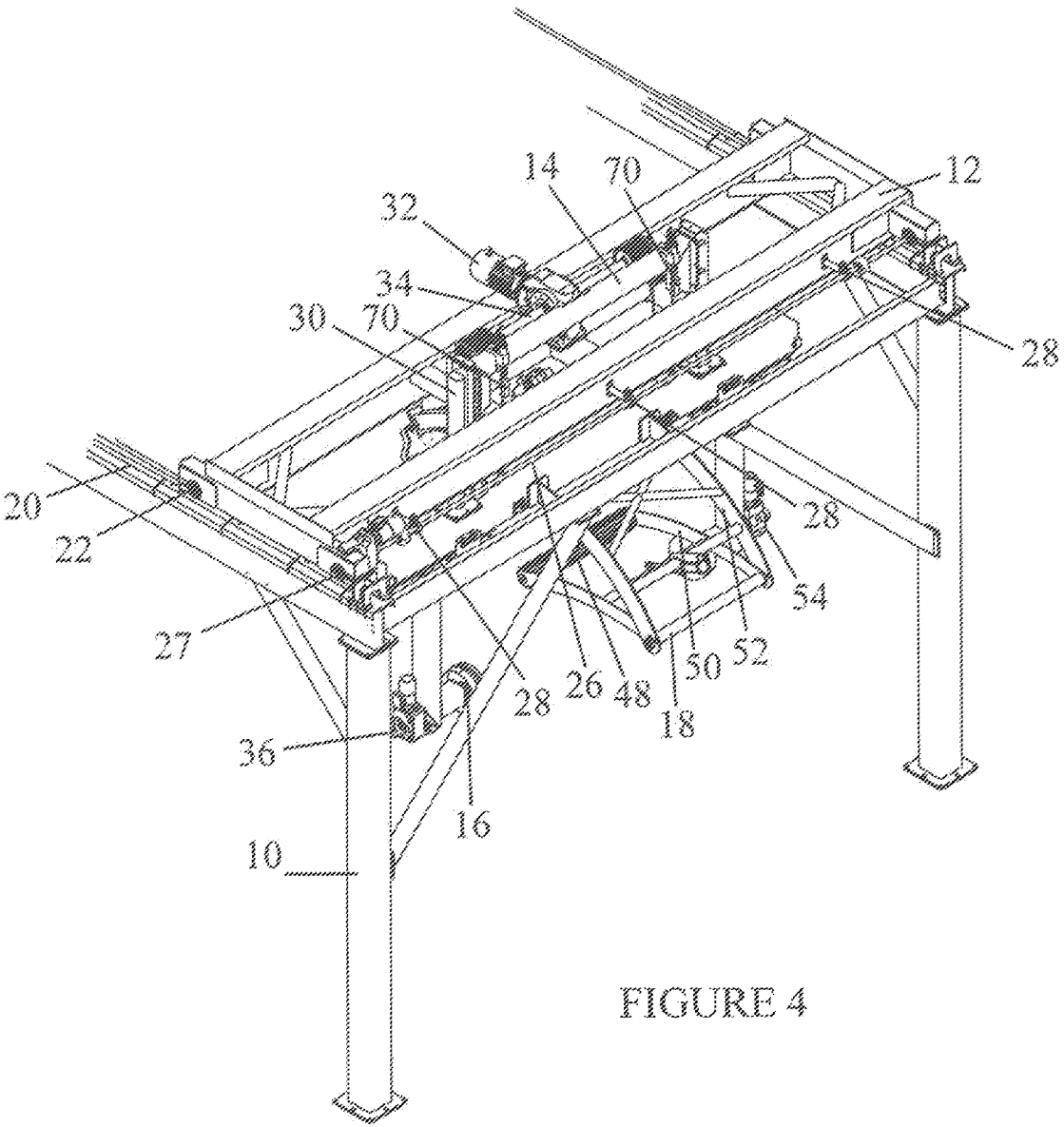
FIG. 4 is a segmented view taken along lines 4-4 of FIG. 1.
Figure 5:
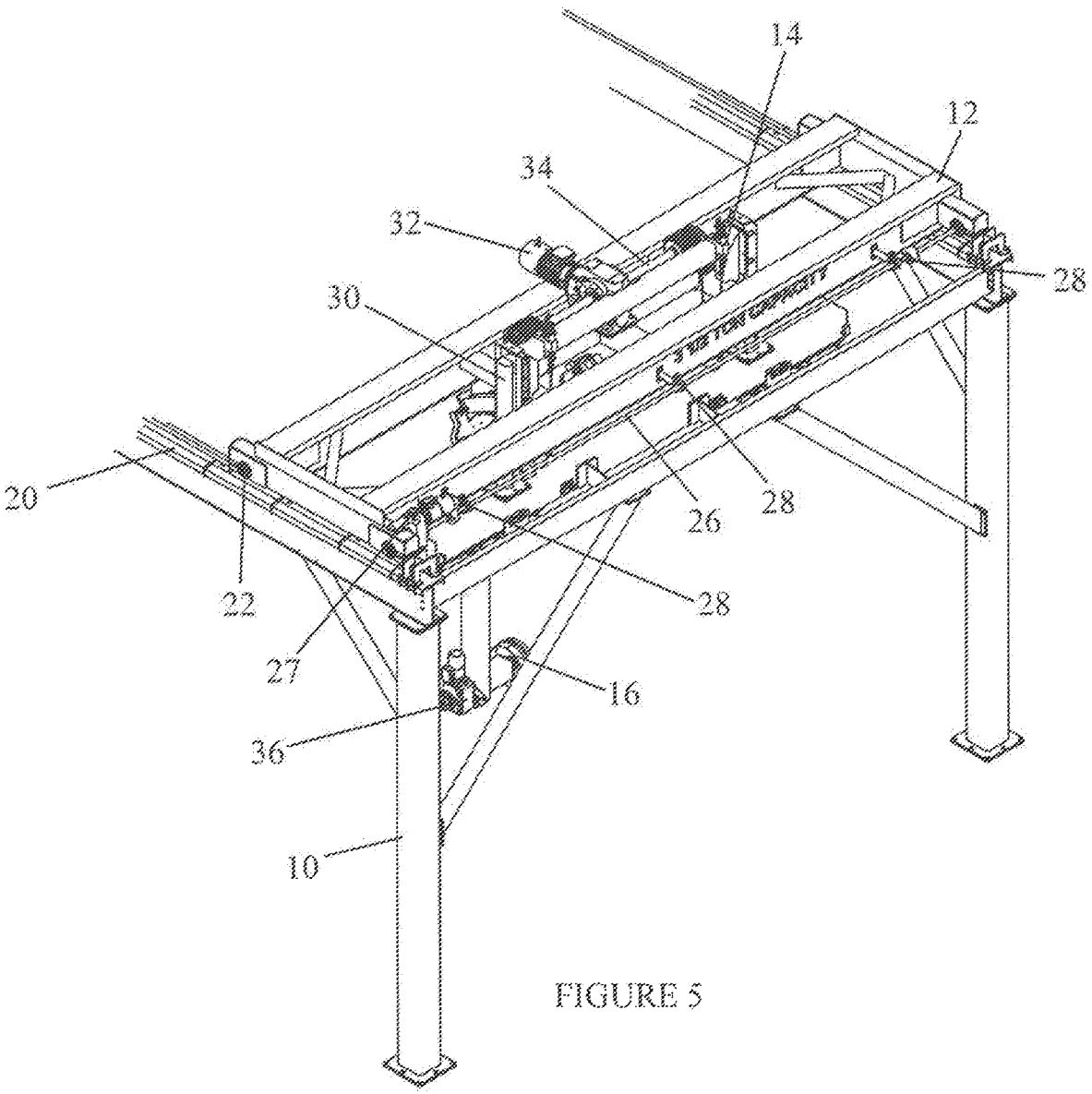
FIG. 5 is an alternative embodiment of the apparatus shown in FIG. 4, with the hold down apparatus removed.

The present invention includes a frame 10 that is commonly positioned proximate a conveyer. The frame 10 supports a carriage 12 that carries a hoist 14. The carriage 12 is movable on the frame 10, allowing it to position itself with regard to a roll of tissue. The hoist 14 will engage the roll with conically shaped chucks 16 and lift the roll off of the surface of the conveyer. The carriage 12 will then move along the frame 10 to a position proximate a location where pulp is designated for removal. Sometimes a pulp catcher is used; other times removed pulp may drop onto a conveyer for transport to a pulping machine.

The frame includes rails 20 posited across the topside of the frame. The carriage 12 rides on the rails 20 and is driven on the rails by drive wheels 22. The drive wheels are powered by a carriage drive motor 27 engaged with a drive shaft 26 supported by bearings 28.

The hoist 14 is supported on the carriage 12 and moves vertically with regard to the carriage 12 on hoist rails 30. Hoist drive motor 32 is engaged with the hoist drive shaft 34. The hoist drive motor 32 will power the hoist 14 vertically, allowing the hoist 14 to lower and engage with rolls and raise to remove the rolls from contact with the conveyer. The hoist 14 further includes drive motors 36 for rotating the chucks 16 engaged with the roll so that the roll is indexed and positioned with respect to a cutting blade 38. The cutting blade 38 is engaged with the hoist 14 by a support frame 40. The cutting blade 38 is attached on the end of an arm 42 carried by the support frame 40. The arm 42 carries a drive motor 44 for powering the cutting blade 38 to cut the tissue from the roll. The drive motor 44 includes a sensor for measuring the amount of torque needed to power the cutting blade 38. If the torque falls outside of preset parameters, the cutting blade 38 is turned off to prevent damage to the cutting blade and roll of material. The cutting arm 42 has a drive motor 46 which enables the cutting blades 38 to be positioned and adjusted to varying diameters of rolls of tissue. The support frame 40, cutting arm 42, and cutting blade 38 are movable horizontally along the hoist 14, preferably by means of a timing belt (not shown). This allows for the cutting blade 38 to be moved along the entire width of the roll being processed.

The present invention further includes a hold down apparatus 18. The hold down apparatus 18 includes a roller 48 which engages with the surface of the roll of material and measures the amount of material being removed from the roll. The roller 48 is carried by an arm 50 which in turn is carried by support arm 52. Support arm 52 is engaged with support arm drive roller 54 which rotates the hold down apparatus 18, placing the hold down roller 48 into engagement with the surface of the roll of tissue. Piston 56 is engaged between support arm 52 and arm 50 and helps ensure that the roller 48 stays engaged with the surface of the roll of tissue.

The entire apparatus is controlled by a PLC with minimal operator input.

In operation, the apparatus of the present invention will position itself proximate a roll to be processed. The roll will be measured with sensors to create a roll profile. The roll profile will indicate the roll size, length, diameter, and weight. A sensor 80 is used to measure the diameter. The PLC will use these measurements to determine the amount of material to be cut off and control the amount of material being cut off based upon the weight of the product, diameter, material type, and further information.

Many of the rolls being processed are non-standard shapes: for instance, pear shaped, egg shaped, etc. The roll profile information will determine how the roll is cut. The roll being cut is based upon operator input. The operator will input pounds per cut. A jumbo roll or parent roll can weigh up to 8,000 pounds. A typical batch of pulp is limited to around 3,000 pounds for transportation to a pulping machine. Knowing the diameter and circumference of the roll, and the general density of the material, the machine calculates the depth of material to be cut off with a single cutting action and sending of the cut off material to the pulp machine. As the diameter of the roll being processed gets smaller, the roll will rotate and drop the cut off material to a specific location. Knowing the blade location and based on the cutting tolerance, the entire unit can be moved to efficiently drop the removed material into small spaces. Finally, the drives of this apparatus include torque control, which will be able to monitor the actual slabbing of the roll. If for some reason the torque on the cutting tool dramatically increases, the cutting can be stopped, and the operator can inspect the roll to determine the cause for the increase in torque. This helps to prevent damage to the equipment.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. An automated apparatus for slabbing large rolls of tissue carried on a hollow core comprising, in combination:

a hoist for carrying the roll of tissue, the hoist including at least one weight measurement sensor for determining the weight of the roll of tissue carried by the hoist;

a carriage carrying a cutting blade, the carriage capable of moving the cutting blade with respect to the roll of tissue;

the cutting blade including a drive means for pressing the cutting blade against the roll of tissue; and wherein the apparatus measures the diameter of the roll and calculates the amount of material to be removed based upon the measured weight and diameter of the roll.

2. The apparatus of claim 1 further including a PLC in communication with the at least one weight measurement sensor and at least one sensor capable of measuring the diameter of the roll, wherein, the PLC calculates the amount of material being cut off the roll of material and controls the amount of material being removed based upon the measured weight and diameter of the roll.

3. The apparatus of claim 1 further including a torque sensor engaged with the cutting blade to determine variations in the material being cut and removed, wherein the torque sensor automatically stops the cutting action if the torque falls outside of an acceptable parameter.

4. The apparatus of claim 1 further including chucks that are used to engage with the interior of the core of the roll of material, the chucks being conical shaped in order to accommodate variations in core size.

5. The apparatus of claim 1 further including a hold down roller which includes a sensor roller for measuring the amount of material being cut and removed from the roll of material.

* * * * *